US005687868A

United States Patent [19]

Kannegaard

[11] Patent Number: 5,687,868

[45] Date of Patent: Nov. 18, 1997

[54] CONTAINER

[75] Inventor: Michael Kannegaard, Tinglev, Denmark

[73] Assignee: Maersk Container Industri AS, Tinglev, Denmark

[21] Appl. No.: 596,205

[22] PCT Filed: Sep. 2, 1994

[86] PCT No.: PCT/DK94/00330

§ 371 Date: Apr. 23, 1996

§ 102(e) Date: Apr. 23, 1996

[87] PCT Pub. No.: WO95/06609

PCT Pub. Date: Mar. 9, 1995

[30] Foreign Application Priority Data

Sep. 3, 1993 [DK] Denmark ..... 0997/93

[51] Int. Cl.[6] ..... B65D 7/26

[52] U.S. Cl. ..... 220/1.5; 220/688; 220/692; 220/662

[58] Field of Search ..... 220/1.5, 688, 692, 220/4.28, 677, 680, 662, 684, 685

[56] References Cited

U.S. PATENT DOCUMENTS 5,052,569 10/1991 Cooper .

FOREIGN PATENT DOCUMENTS 3503053 7/1986 Germany .

*Primary Examiner*—Joseph M. Moy
*Attorney, Agent, or Firm*—Ladas & Parry

[57] ABSTRACT

A container (1) provided with profiled wall and roof panels (2, 3) which are secured to each other via welded U-profiles (5). One leg (6') of the U-profiles (5) comprises an inwardly extending flap (8) for the subsequent mounting of transverse suspension devices (9). The container can hereby be equipped with suspension devices for the suspension of goods at any time in operation, without it being necessary to take the container out of service to perform a time-consuming subsequent mounting by riveting or welding of rails or profiles.

8 Claims, 2 Drawing Sheets

CONTAINER

FIELD OF THE INVENTION

The present invention concerns a container having profiled wall and roof panels which are secured to each other at the longitudinal edge joints by welded, profiled longitudinal girders.

BACKGROUND

In the known containers (dry cargo) the profiled longitudinal girders are formed by closed profiles, preferably four-sided profiles. When goods are to be transported in the container in a suspended state, the longitudinal girders are provided with rails or profiles for the attachment of cross beams from which the goods hang down.

Only when there is need for transporting suspended goods in the container, is the container provided with said rails or profiles, which are subsequently riveted or welded to the longitudinal girders. This subsequent mounting causes damage to the internal surface finish of the container, and in case of welding also damage to the external surface finish. The subsequent mounting moreover involves additional costs in that the container is to be taken out of service, is to be transported to a workshop in which the subsequent mounting is to be performed, and is then to be sent back to be put into service. The subsequently mounted container is thus often in a poorer state, in particular as regards the surface finish, than the container was beforehand.

SUMMARY OF THE INVENTION

The object of the present invention is therefore to provide a container which is provided with expedient means already during the actual manufacture for the mounting of transverse suspension beams for the goods.

The container of the present invention is characterized in that the longitudinal girders are formed by profiles which are formed integrally with longitudinal, inwardly extending flaps for the subsequent mounting of transverse suspension devices.

Accordingly, there is provided a container which need not to be subsequently equipped with rails or profiles for the mounting of transverse suspension beams, and which is simultaneously both simple and inexpensive to manufacture, since it can be manufactured at the existing production plants.

According to the invention, the profiled longitudinal girders may be provided as "open" profiles so that the longitudinal girders, and thereby the entire container, can be formed without cavities that might contain contraband goods, such as narcotics or the like.

Further, according to the invention, the longitudinal girders may be formed by U-profiles arranged so that the legs of the U extend substantially horizontally, said flaps being formed by the lower leg of the U. The transverse suspension beams, and hereby the suspended goods, may hereby be arranged quite close below the roof panel.

Said flanges may be formed by an extension of one leg of the U in a particularly simple manner.

According to the invention, the longitudinal girders may be formed by other "open" profiles, such as I-profiles, where said flaps are formed by one portion of the lower flange of the I.

Finally, according to the invention, the inwardly directed edge of the flap may be provided with a thickening to retain and control the mounting device of the transverse suspension beam at the end.

BRIEF DESCRIPTION OF THE DRAWING

The invention will be explained more fully below with reference to a particularly preferred embodiment illustrated in the drawing, in which.

DETAILED DESCRIPTION

Figure 1:
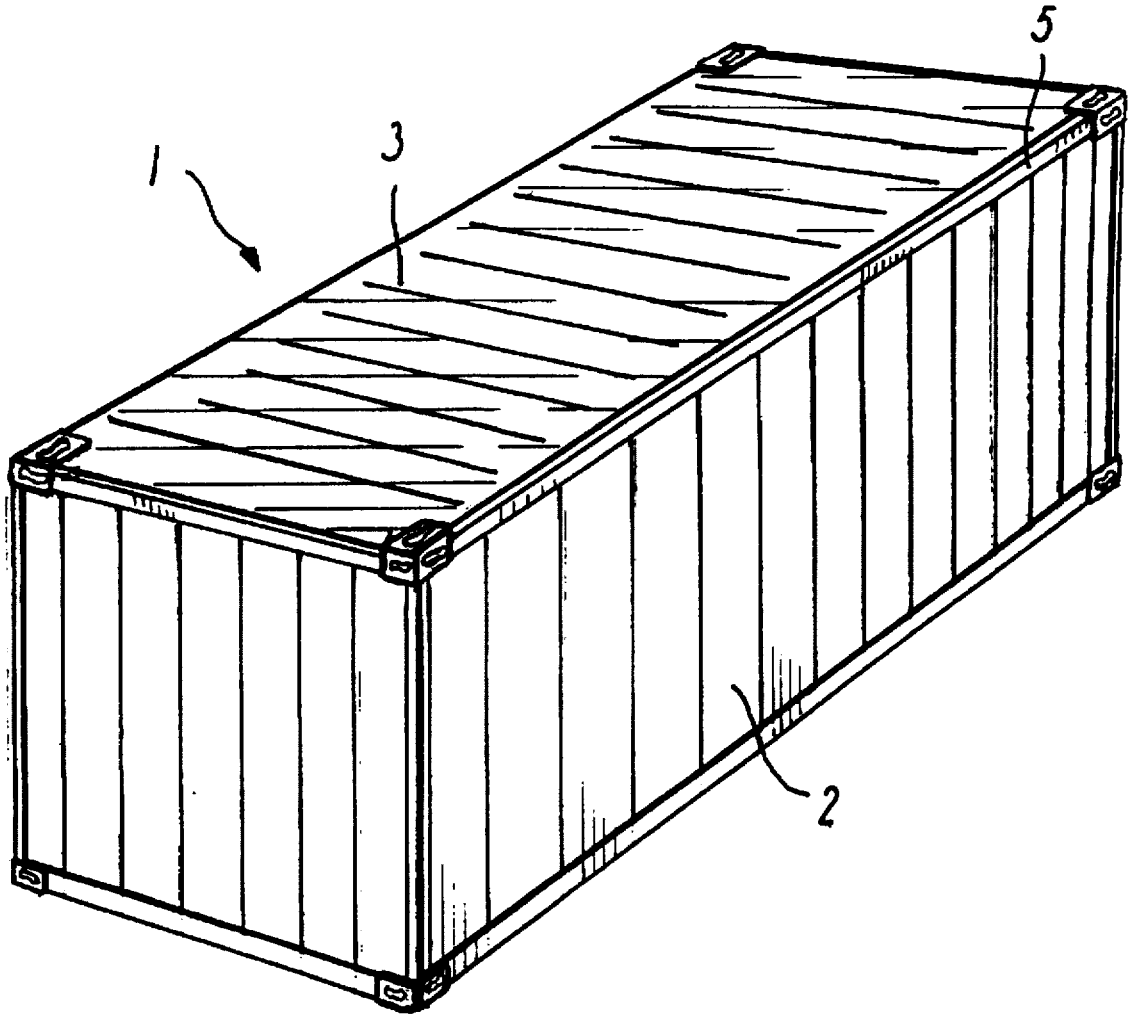
FIG. 1 is a schematic perspective view of a dry cargo container provided with the longitudinal girders of the invention.
Figure 2:
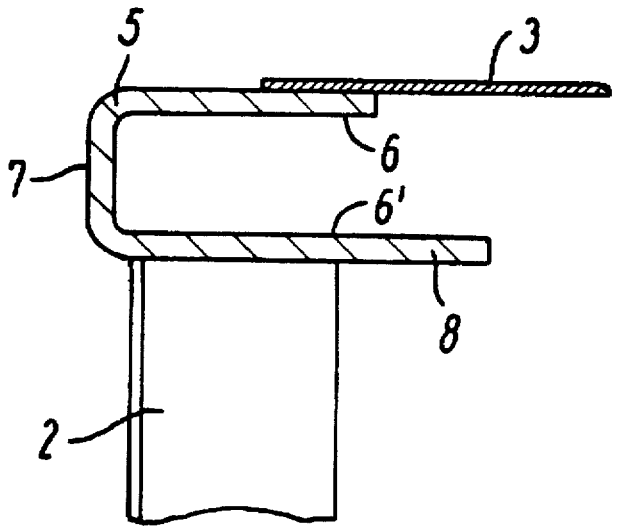
FIG. 2 is a schematic sectional view of a longitudinal edge joint comprising a U-shaped longitudinal girder.

The dry cargo container shown in FIG. 1 comprises profiled wall and roof panels 2, 3, which are secured to each other at the longitudinal edge joints 4 via welded profiled longitudinal girders 5.

The profiled longitudinal girders may be formed as U-profiles 5 in a particularly expedient manner, arranged so that the legs 6, 6' of the U 5 extend substantially horizontally from the outwardly directed bottom 7 of the U and inwardly in the container.

In the shown embodiment, the lower leg 6' of the U 5 is 30 extended with respect to the upper leg 6 of the U 5 and thereby forms the said inwardly directed flap 8.

Figure 3:
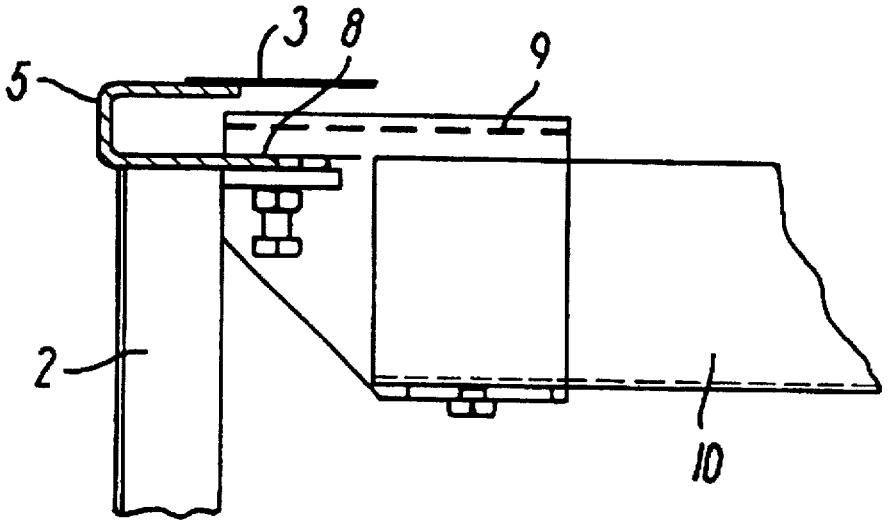
FIG. 3 is a reduced-scale view of the same with a mounted suspension beam.

As shown in FIG. 3, the longitudinal inwardly directed flap 8 can hereby be used in a particularly expedient manner for the mounting of suspension devices 9 arranged at the end of transverse suspension beams 10 for the suspension of the goods during transport.

In the shown embodiment, the transverse suspension beams 10 may be arranged right up below the roof panel 3 of the container in a particularly expedient manner so as to obtain the greatest possible height for the suspended goods.

The "open" U-profile 5 is simultaneously free of closed cavities in which contraband goods, such as narcotics and the like, might be placed.

The container of the invention is simple and inexpensive to manufacture, since it can be manufactured directly at the existing manufacturing plants.

Many modifications are possible, without departing from the idea of the invention. Thus, the longitudinal girders can be provided in many different designs, such as e.g. the form of I-profiles, as long as they are provided with the inwardly directed flap. The actual flap, too, may have different shapes and may e.g. be provided with a thickening at its inwardly facing edge.

What is claimed is:

1. A container comprising profiled wall and roof panels secured at longitudinal edge joints by profiled longitudinal girders, said container having an interior and further comprising attachment means extending inwardly into the interior of the container for mounting of suspension devices within the interior of the container, each of said longitudinal girders comprising a profiled member having upper and lower flanges connected by a base, said flanges and said base forming an open channel facing inwardly into said interior of the container, said lower flange being integrally formed with a longitudinally inwardly extending flap serving as said attachment means, said wall and roof panels being secured to the longitudinal girders by welding.

2. A container as claimed in claim 1, wherein said upper and lower flanges of said girders extend parallel to said roof panels, said longitudinally inwardly extending flap on said lower flange being parallel to said roof panel.

3. A container as claimed in claim 2, wherein said roof panels extend horizontally and said wall panels extend vertically, said open channel of said profiled member facing horizontally into said interior of said container.

4. A container as claimed in claim 3, wherein said upper and lower flanges extend horizontally and said flap extends horizontally as an extension of said lower flange.

5. A container as claimed in claim 4, wherein said girders each has a U-shaped profile.

6. A container as claimed in claim 5, wherein said roof panels are welded to said upper flanges of said girders and said wall panels are welded to said lower flanges of said girders.

7. A container as claimed in claim 6, wherein said open channel of each girder is open and accessible to the interior of the container between said roof panel and said flap.

8. A container as claimed in claim 7, wherein said vertically extending wall panels abut against and are welded to a lower surface of the horizontally extending lower flanges of said girders, said bases of said girders extending vertically and facing outwardly of said container.

* * * * *